US011187434B2

(12) United States Patent
Suzuki

(10) Patent No.: US 11,187,434 B2
(45) Date of Patent: Nov. 30, 2021

(54) HEAT PUMP APPARATUS AND METHOD FOR INSTALLING THE SAME

(71) Applicant: Mitsubishi Electric Corporation, Tokyo (JP)

(72) Inventor: Yasuhiro Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 21 days.

(21) Appl. No.: 16/474,409

(22) PCT Filed: Mar. 15, 2017

(86) PCT No.: PCT/JP2017/010327

§ 371 (c)(1),
(2) Date: Jun. 27, 2019

(87) PCT Pub. No.: WO2018/167861

PCT Pub. Date: Sep. 20, 2018

(65) Prior Publication Data

US 2019/0390873 A1 Dec. 26, 2019

(51) Int. Cl.

| | |
|---|---|
| ***F24H 4/02*** | (2006.01) |
| ***F24H 9/20*** | (2006.01) |
| ***F25D 21/00*** | (2006.01) |

(52) U.S. Cl.

CPC ..... *F24H 4/02* (2013.01); *F24H 9/2007* (2013.01); *F25B 2400/12* (2013.01);
(Continued)

(58) Field of Classification Search

CPC ..... F24H 4/02; F24H 9/2007; F25B 2400/12; F25B 2700/151; F25B 2700/2116;
(Continued)

(56) References Cited

U.S. PATENT DOCUMENTS 9,003,817 B2 * 4/2015 Endoh ..... F24D 11/0221 62/175
10,247,441 B2 * 4/2019 Suzuki ..... F24F 11/36
(Continued)

FOREIGN PATENT DOCUMENTS

JP H05-008261 U 2/1993
JP H06-088638 A 3/1994
(Continued)

OTHER PUBLICATIONS

Translated of JP 2013167398 A (Year: 2013).*
(Continued)

*Primary Examiner* — Ana M Vazquez
(74) *Attorney, Agent, or Firm* — Posz Law Group, PLC

(57) ABSTRACT

A heat pump apparatus includes: a refrigerant circuit which circulates refrigerant; a heat medium circuit which makes a heat medium flow; a heat exchanger which cause heat exchange to be performed between the refrigerant and the heat medium; and an indoor unit which houses at least the heat exchanger. The heat exchanger has a double-wall structure. The indoor unit includes a container which houses the heat exchanger. In the container, a first opening port is formed to communicate with an outdoor space without communicating with an indoor space.

12 Claims, 4 Drawing Sheets

(52) U.S. Cl.
CPC . *F25B 2700/151* (2013.01); *F25B 2700/2116* (2013.01); *F25B 2700/2117* (2013.01); *F25D 21/006* (2013.01)

(58) Field of Classification Search
CPC .... F25B 2700/2117; F25B 30/02; F25B 1/00; F25B 49/02; F25D 21/006; F24F 7/06; F24F 11/36; F24F 13/20; F24F 13/30; F24F 1/0059; F28F 1/00
See application file for complete search history.

(56) References Cited

U.S. PATENT DOCUMENTS

| | | | | |
|---|---|---|---|---|
| 2013/0192283 | A1* | 8/2013 | Yamashita | F25B 49/005 62/126 |
| 2017/0227262 | A1 | 8/2017 | Suzuki et al. | |
| 2017/0292744 | A1 | 10/2017 | Suzuki et al. | |
| 2018/0073811 | A1* | 3/2018 | Taras | F28F 3/046 |

FOREIGN PATENT DOCUMENTS

| | | | | |
|---|---|---|---|---|
| JP | H09-324928 | A | | 12/1997 |
| JP | 2001-208392 | A | | 8/2001 |
| JP | 2008-175450 | A | | 7/2008 |
| JP | 2009-228923 | A | | 10/2009 |
| JP | 2010-223486 | A | | 10/2010 |
| JP | 2013-167398 | A | | 8/2013 |
| JP | 2013167398 | A | * | 8/2013 |
| JP | 2016-065674 | A | | 4/2016 |
| KR | 101898592 | B1 | * | 9/2018 |
| WO | 2013/038599 | A1 | | 3/2013 |
| WO | 2016/084128 | A1 | | 6/2016 |

OTHER PUBLICATIONS

Janghee Park et al. "Translated of KR 101898592 B1", 2016 (Year: 2016).*

Office Action dated May 12, 2020 issued in corresponding JP patent application No. 2019-505576 (and English translation).

Extended European Search Report dated Feb. 28, 2020 for the corresponding EP applicatind No. 17900920.4.

International Search Report of the International Searching Authority dated May 30, 2017 for the corresponding international application No. PCT/JP2017/010327 (and English translation).

* cited by examiner

HEAT PUMP APPARATUS AND METHOD FOR INSTALLING THE SAME

CROSS REFERENCE TO RELATED APPLICATION

This application is a U.S. national stage application of PCT/JP2017/010327 filed on Mar. 15, 2017, the contents of which are incorporated herein by reference.

TECHNICAL FIELD

The present invention relates to a heat pump apparatus including a refrigerant circuit which circulates refrigerant and a heat medium circuit which causes a heat medium to flow therein, and a method for installing the heat pump apparatus.

BACKGROUND ART

A heat pump apparatus described in Patent Literature 1 uses flammable refrigerant. An outdoor unit of the heat pump apparatus includes a refrigerant circuit in which a compressor, an air heat exchanger, an expansion device and a water heat exchanger are connected by pipes; and at least one of a pressure relief valve which prevents the pressure of water from excessively rising and a water circuit which supplies water heated by the water heat exchanger and an air vent valve which allows air to be discharged from the water circuit. By virtue of this configuration, in the water heat exchanger, even if a partition wall isolating the refrigerant circuit and the water circuit from each other is broken, and the flammable refrigerant enters the water circuit, the flammable refrigerant can be discharged to an outdoor space through the pressure relief valve or the air vent valve.

CITATION LIST

Patent Literature

Patent Literature 1: Japanese Unexamined Patent Application Publication No. 2013-167398

SUMMARY OF INVENTION

Technical Problem

In the heat pump apparatus described in Patent Literature 1, the water heat exchanger is provided in the outdoor unit. In this case, since part of the water circuit is provided in the outdoor unit, the pressure relief valve or the air vent valve can be provided in the part of the water circuit that is provided in the outdoor unit. On the other hand, in some heat pump apparatuses, a water heat exchanger is provided in an indoor unit. In this case, since an outdoor unit is not provided with a water circuit, a pressure relief valve or an air vent valve is inevitably provided in the indoor unit. Therefore, if entering enters the water circuit, refrigerant may leak into an indoor space through the pressure relief valve or air vent valve.

The present invention has been made to solve the above problem, and an object of the invention is to provide a heat pump apparatus in which even if a partition wall in a heat exchanger housed in an indoor unit is damaged, refrigerant can be prevented from leaking and flowing into an indoor space, and a method for installing the heat pump apparatus.

Solution to Problem

A heat pump apparatus according to an embodiment of the present invention includes: a refrigerant circuit which circulates refrigerant; a heat medium circuit which makes a heat medium flow; a heat exchanger which cause heat exchange to be performed between the refrigerant and the heat medium; and an indoor unit housing at least the heat exchanger. The heat exchanger has a double-wall structure. The indoor unit includes a container housing the heat exchanger. In the container, a first opening port is formed to communicate with an outdoor space without communicating with an indoor space.

A method for installing a heat pump apparatus, according to another embodiment of the present invention, the heat pump apparatus including: a refrigerant circuit which circulates refrigerant; a heat medium circuit which makes a heat medium flow; a heat exchanger which causes heat exchange to be performed between the refrigerant and the heat medium; and an indoor unit which houses at least the heat exchanger, the heat exchanger having a double-wall structure, the indoor unit including a container which houses the heat exchanger, the container including an opening port formed therein, the method includes setting, when installing the indoor unit in an indoor space, the opening port such that the opening port communicates with an outdoor space without communicating with the indoor space.

Advantageous Effects of Invention

According to the embodiment of the present invention, even if a partition wall of the heat exchanger housed in the indoor unit is damaged, and as a result refrigerant flows out from the heat exchanger, the refrigerant flows into the space in the container and is then discharged to the outdoor space through the first opening port. Therefore, even if the partition wall of the heat exchanger housed in the indoor unit is damaged, leakage of the refrigerant into the indoor space can be prevented.

DESCRIPTION OF EMBODIMENTS

Embodiment 1

Figure 1:
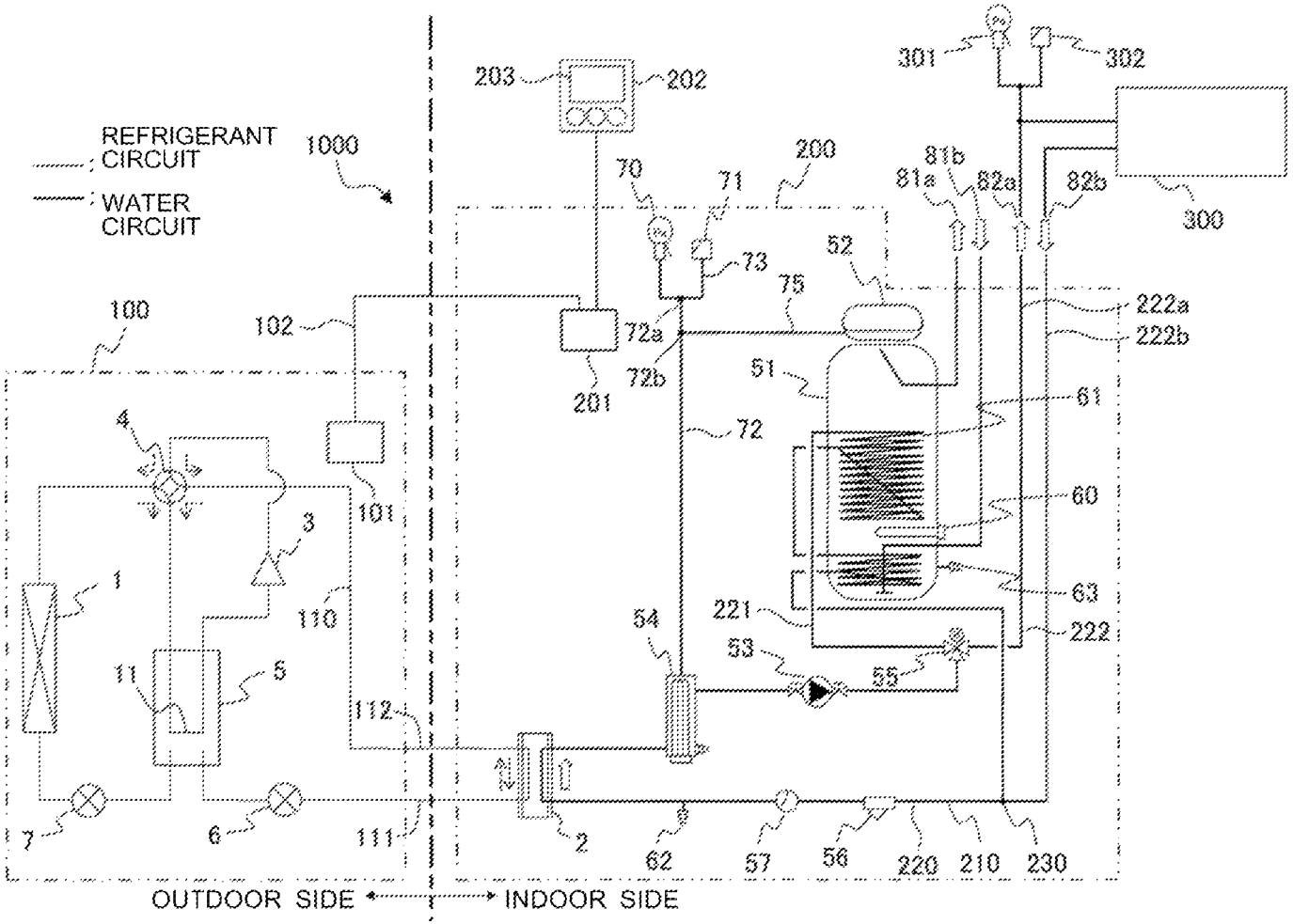
FIG. 1 is a circuit diagram illustrating a schematic configuration of a heat pump apparatus according to embodiment 1 of the present invention.

A heat pump apparatus according to embodiment 1 of the present invention will be described. FIG. 1 is a circuit diagram illustrating a schematic configuration of the heat pump apparatus according to embodiment 1. In embodiment 1, a heat-pump hot-water supply heating apparatus 1000 is provided as an example of the heat pump apparatus. In figures including FIG. 1 which will be referred to below, the relationships in size, shape, etc. between components may be different from actual ones.

As illustrated in FIG. 1, the heat-pump hot-water supply heating apparatus 1000 includes a refrigerant circuit 110 in which refrigerant is circulated and a water circuit 210 in which water is made to flow. The heat-pump hot-water supply heating apparatus 1000 further includes an outdoor unit 100 installed in an outdoor space (for example, outdoors) and an indoor unit 200 installed in an indoor space. The indoor unit 200 is installed in, for example, a kitchen, a bathroom, a laundry room, or a storage space such as a closet in a building.

In the refrigerant circuit 110, a compressor 3, a refrigerant flow switching device 4, a load-side heat exchanger 2, a first pressure-reducing device 6, an intermediate-pressure receiver 5, a second pressure-reducing device 7 and a heat-source-side heat exchanger 1 are sequentially connected by refrigerant pipes. The refrigerant circuit 110 of the heat-pump hot-water supply heating apparatus 1000 is capable of performing a regular operation (for example, a heating and hot-water supplying operation) in which water flowing in the water circuit 210 is heated and a defrosting operation in which refrigerant is made to flow in an opposite direction to the flow direction of refrigerant in the regular operation to defrost the heat-source-side heat exchanger 1.

The compressor 3 is a fluid machine which compresses low-pressure refrigerant sucked therein into high-pressure refrigerant, and discharges the high-pressure refrigerant. In embodiment 1, the compressor 3 includes an inverter device, etc., and can change its capacity (an amount of refrigerant that can be sent per time) by arbitrarily changing a driving frequency.

The refrigerant flow switching device 4 switches the flow direction of the refrigerant in the refrigerant circuit 110 between that in the regular operation and that in the defrosting operation. As the refrigerant flow switching device 4, for example, a four-way valve is used.

The load-side heat exchanger 2 is a water-refrigerant heat exchanger which causes heat exchange to be performed between refrigerant flowing in the refrigerant circuit 110 and water flowing in the water circuit 210. During the regular operation, the load-side heat exchanger 2 operates as a condenser (heat transferring device) which heats water, and operates as an evaporator (heat receiving device) during the defrosting operation. As the load-side heat exchanger 2, a heat exchanger having a double-wall structure is used. The double-wall structure is a structure in which two partition walls are provided between a refrigerant flow passage and a water flow passage. In embodiment 1, a plate heat exchanger having a double-wall structure is used.

Figure 2:
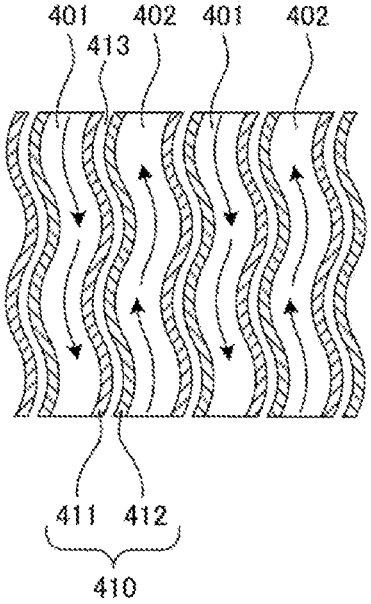
FIG. 2 is a schematic view illustrating a configuration of a main portion of a load-side heat exchanger 2 of the heat pump apparatus according to embodiment 1.

FIG. 2 is a schematic view illustrating a configuration of a main portion of the load-side heat exchanger 2 of the heat pump apparatus according to embodiment 1. As illustrated in FIG. 2, the load-side heat exchanger 2 includes refrigerant flow passages 401 which serve as part of the refrigerant circuit 110 to allow refrigerant to flow, and water flow passages 402 which are formed along the refrigerant flow passages 401 and serve as part of the water circuit 210 to allow water to flow. In the plate heat exchanger, a plurality of refrigerant flow passages 401 and a plurality of water flow passages 402 are alternately arranged.

The refrigerant flow passages 401 and the water flow passages 402 are isolated from each other by partition walls 410 provided as a double structure. The partition walls 410 include a first partition wall 411 formed in the shape of a thin plate and extending along the refrigerant flow passage 401 and a second partition wall 412 formed in the shape of a thin plate and extending along the water flow passage 402. The second partition wall 412 is thermally connected with the first partition wall 411. A gap 413 is provided between the first partition wall 411 and the second partition wall 412. The gap 413 communicates with space located outside the heat exchanger (for example, space in which the heat exchanger is installed). When the load-side heat exchanger 2 operates as a condenser, heat of the refrigerant flowing through the refrigerant flow passage 401 is transmitted, through the first partition wall 411 and second partition wall 412, to water flowing through the water flow passage 402. When the load-side heat exchanger 2 operates as an evaporator, heat of the water flowing through the water flow passage 402 is transmitted, through the second partition wall 412 and first partition wall 411, to the refrigerant flowing through the refrigerant flow passage 401.

Referring back to FIG. 1, the first pressure-reducing device 6 adjusts the flow rate of refrigerant to adjust the pressure of refrigerant flowing through, for example, the load-side heat exchanger 2. The intermediate-pressure receiver 5 is located between the first pressure-reducing device 6 and a second pressure-reducing device 7 in the refrigerant circuit 110, and stores surplus refrigerant. In the intermediate-pressure receiver 5, a suction pipe 11 is extended and connected to a suction side of the compressor 3. In the intermediate-pressure receiver 5, heat exchange is performed between refrigerant flowing through the suction pipe 11 and refrigerant in the intermediate-pressure receiver 5. Therefore, the intermediate-pressure receiver 5 also functions as an internal heat exchanger in the refrigerant circuit 110. The second pressure-reducing device 7 adjusts the flow rate of refrigerant to adjust the pressure of the refrigerant. In embodiment 1, the first pressure-reducing device 6 and the second pressure-reducing device 7 are electronic expansion valves whose opening degrees can be changed by control by a controller 101 to be described later.

The heat-source-side heat exchanger 1 is an air-refrigerant heat exchanger which causes heat exchange to be performed between refrigerant flowing through the refrigerant circuit 110 and outdoor air sent by an outdoor fan (not illustrated) or the like. During the regular operation, the heat-source-side heat exchanger 1 operates as an evaporator (heat receiving device) which receives heat from air. During the defrosting operation, the heat-source-side heat exchanger 1 operates as a condenser (heat transferring device).

For example, a slightly flammable refrigerant such as R1234yf or R1234ze(E) or a highly flammable refrigerant such as R290 or R1270 is used as refrigerant to be circulated in the refrigerant circuit 110. Each of these refrigerants may be used as a single refrigerant, or two or more of them may be mixed and used as a mixed refrigerant. Hereinafter, there is a case where a refrigerant having flammability of at least a slightly flammable level (for example, at least 2 L under ASHRAE34 classification) will be referred to as "refrigerant having flammability" or "flammable refrigerant." Furthermore, an inflammable refrigerant having inflammability (1 under ASHRAE34 classification, for example) such as R407C or R410A can be used as the refrigerant to be circulated in the refrigerant circuit 110. These refrigerants have a higher density than air under atmospheric pressure (for example, room temperature [25 degrees Celsius]). Furthermore, refrigerant having toxicity, such as R717 (ammonia), can be used as the refrigerant to be circulated in the refrigerant circuit 110.

The compressor 3, the refrigerant flow switching device 4, the first pressure-reducing device 6, the intermediate-pressure receiver 5, the second pressure-reducing device 7 and heat-source-side heat exchanger 1 are housed in the outdoor unit 100. The load-side heat exchanger 2 is housed in the indoor unit 200. That is, the heat-pump hot-water supply heating apparatus 1000 is a split-type heat-pump hot-water supply heating apparatus in which part of the refrigerant circuit 110 is housed in the outdoor unit 100 and other part of the refrigerant circuit 110 is housed in the indoor unit 200. The outdoor unit 100 and the indoor unit 200 are connected to each other by two connection pipes 111 and 112 which form part of the refrigerant circuit 110.

Furthermore, the outdoor unit 100 includes the controller 101 which controls, as a main control, the operation of the refrigerant circuit 110 (for example, the compressor 3, the refrigerant flow switching device 4, the first pressure-reducing device 6, the second pressure-reducing device 7, the outdoor fan, etc.). The controller 101 includes a microcomputer provided with a CPU, a ROM, a RAM, an I/O port, etc. 5 The controller 101 is capable of intercommunicating, via a control line 102, with a controller 201 and an operating portion 202, which will be described later.

Next, an example of an operation of the refrigerant circuit 110 will be described. In FIG. 1, flow directions of refrigerant in the refrigerant circuit 110 during the regular operation are indicated by solid arrows. During the regular operation, in the refrigerant circuit 110, the refrigerant flow switching device 4 changes the refrigerant flow passage to the refrigerant flow passage indicated by the solid arrows in a switching manner, and high-temperature, high-pressure refrigerant flows into the load-side heat exchanger 2.

The high-temperature, high-pressure gas refrigerant discharged from the compressor 3 passes through the refrigerant flow switching device 4 and flows into the refrigerant flow passage 401 of the load-side heat exchanger 2. In the regular operation, the load-side heat exchanger 2 operates as a condenser. That is, the load-side heat exchanger 2 causes heat exchange to be performed between refrigerant flowing through the refrigerant flow passage 401 and water flowing through the water flow passage 402, and the condensation heat of the refrigerant is transferred to the water. Thereby, the refrigerant flowing through the refrigerant flow passage 401 of the load-side heat exchanger 2 condenses and changes into high-pressure liquid refrigerant. Furthermore, the water flowing through the water flow passage 402 of the load-side heat exchanger 2 is heated by the heat transferred from the refrigerant.

The high-pressure liquid refrigerant condensed at the load-side heat exchanger 2 flows into the first pressure-reducing device 6, and is slightly reduced in pressure to change into two-phase refrigerant. The two-phase refrigerant flows into the intermediate-pressure receiver 5, and is cooled through heat exchange with low-pressure gas refrigerant flowing through the suction pipe 11 to change into liquid refrigerant. The liquid refrigerant flows into the second pressure-reducing device 7, and is reduced in pressure to change into low-pressure, two-phase refrigerant. The low-pressure, two-phase refrigerant flows into the heat-source-side heat exchanger 1. In the regular operation, the heat-source-side heat exchanger 1 operates as an evaporator. To be more specific, in the heat-source-side heat exchanger 1, heat exchange is carried out between the refrigerant flowing in the heat-source-side heat exchanger 1 and the outdoor air sent by the outdoor fan, whereby the evaporation heat of the refrigerant is received by the outdoor air. By virtue of this configuration, the low-pressure, two-phase refrigerant having flowed into the heat-source-side heat exchanger 1 evaporates and changes into low-pressure gas refrigerant. The low-pressure gas refrigerant flows into the suction pipe 11 through the refrigerant flow switching device 4. The low-pressure gas refrigerant having flowed into the suction pipe 11 is heated through heat exchange with the refrigerant in the intermediate-pressure receiver 5, and is sucked into the compressor 3. The refrigerant sucked into the compressor 3 is compressed and changes into high-temperature, high-pressure gas refrigerant. In the regular operation, the above cycle is continuously repeated.

Next, it will be described by way of example what operation is performed during the defrosting operation. In FIG. 1, broken arrows indicate the flow direction of the refrigerant in the refrigerant circuit 110 in the defrosting operation. In the defrosting operation, in the refrigerant circuit 110, the refrigerant flow switching device 4 changes the refrigerant flow passage to the refrigerant flow passage indicated by the broken arrows in the switching manner, whereby the high-temperature, high-pressure refrigerant flows into the heat-source-side heat exchanger 1.

The high-temperature, high-pressure gas refrigerant discharged from the compressor 3 flows into the heat-source-side heat exchanger 1 through the refrigerant flow switching device 4. In the defrosting operation, the heat-source-side heat exchanger 1 operates as a condenser. To be more specific, in the heat-source-side heat exchanger 1, the condensation heat of the refrigerant flowing therein is transferred to frost formed on a surface of the heat-source-side heat exchanger 1. By virtue of this configuration, the refrigerant flowing in the heat-source-side heat exchanger 1 condenses and changes into high-pressure liquid refrigerant. Further, the frost formed on the surface of the heat-source-side heat exchanger 1 is melted by the heat transferred from the refrigerant.

The high-pressure liquid refrigerant condensed by the heat-source-side heat exchanger 1 passes through the second pressure-reducing device 7, the intermediate-pressure receiver 5 and the first pressure-reducing device 6 to change into low-pressure, two-phase refrigerant. The low-pressure, two-phase refrigerant flows into the refrigerant flow passage 401 of the load-side heat exchanger 2. In the defrosting operation, the load-side heat exchanger 2 operates as an evaporator. That is, in the load-side heat exchanger 2, heat exchange is performed between the refrigerant flowing through the refrigerant flow passage 401 and the water flowing through the water flow passage 402, whereby heat is received from the water as the evaporation heat of the refrigerant. By virtue of this configuration, the refrigerant flowing in the refrigerant flow passage 401 of the load-side heat exchanger 2 evaporates and changes into low-pressure gas refrigerant. The gas refrigerant passes through the refrigerant flow switching device 4 and the suction pipe 11, and is then sucked into the compressor 3. The refrigerant sucked into the compressor 3 is compressed to change into high-temperature, high-pressure gas refrigerant. In the defrosting operation, the above cycle is continuously repeated.

Next, the water circuit 210 will be described. In embodiment 1, the water circuit 210 is a closed circuit which circulates water. In FIG. 1, outlined allows indicate flow directions of water. The water circuit 210 is housed in the indoor unit 200. The water circuit 210 includes a main circuit 220, a branch circuit 221 forming a hot-water supply circuit, and a branch circuit 222 forming part of a heating circuit. The main circuit 220 forms part of a closed circuit. The branch circuits 221 and 222 branch off from the main circuit 220 and then connected again to the main circuit 220.

The branch circuits 221 and 222 are provided parallel to each other. The branch circuit 221 forms along with the main circuit 220 a closed circuit. The branch circuit 222 forms along with the main circuit 220 and circuits installed at a designated site, such as a heating apparatus 300 connected to the branch circuit 222, a closed circuit. The heating apparatus 300 is installed indoors separately from the indoor unit 200. As the heating apparatus 300, for example, a radiator or a floor-heating apparatus is used.

With respect to embodiment 1, although water is described as an example of a heat medium which flows in the water circuit 210, another liquid heat medium such as brine, gas heat medium or a heat medium can be used as the heat medium.

In the main circuit 220, a strainer 56, a flow switch 57, the load-side heat exchanger 2, a booster heater 54, a pump 53, etc., are connected by water pipes. At intermediate part of the water pipes forming the main circuit 220, a drain outlet 62 is provided to drain water in the water circuit 210. A downstream end of the main circuit 220 is connected to a three-way valve 55 (an example of a branching part). The three-way valve 55 includes a single inflow port and two outflow ports. To the inflow port of the three-way valve 55, the main circuit is connected. To one of the outflow ports of the three-way valve 55, the branch circuit 221 is connected, and to the other outlet flow port of the three-way valve 55, the branch circuit 222 is connected. To be more specific, at the three-way valve 55, the branch circuits 221 and 222 branch off from the main circuit 220. An upstream end of the main circuit 220 is connected to a joining part 230. At the joining part 230, the branch circuits 221 and 222 join the main circuit 220. Part of the water circuit 210 which extends from the joining part 230 to the three-way valve 55 via the load-side heat exchanger 2, etc., forms the main circuit 220. The main circuit 220 is provided in the indoor unit 200.

The pump 53 is a device which pressurizes the water in the water circuit 210 to circulate the water in the water circuit 210. The booster heater 54 is a device which further heats the water in the water circuit 210, for example, when the heating capacity of the load-side heat exchanger 2 in the refrigerant circuit 110 is insufficient. The three-way valve 55 is a device which changes the flow of the water in the water circuit 210 in a switching manner. For example, the three-way valve 55 switches the flow of the water in the main circuit 220 between circulation of water in the branch circuit 221 and circulation of water in the branch circuit 222. The strainer 56 is a device which removes scale in the water circuit 210. The flow switch 57 is a device which detects whether the flow rate of the water circulating in the water circuit 210 is higher than or equal to a certain rate. The flow switch 57 can be replaced by a flow-rate sensor.

The booster heater 54 is connected to a pressure relief valve 70 (an example of a pressure protective device) and an air vent valve 71 (an example of an air vent device). That is, the booster heater 54 is a connection portion at which the pressure relief valve 70 and the air vent valve 71 are connected to the water circuit 210. The booster heater 54 may be hereinafter referred to as "connection portion." In the case where the pressure relief and air vent valves 70 and 71 are connected to the branch circuits 221 and 222, it is necessary that respective sets of pressure relief valves 70 and air vent valves 71 are provided for the branch circuits 221 and 222. In embodiment 1, since the pressure relief and air bent valves 70 and 71 are connected to the main circuit 220, it suffices that one pressure relief valve 70 and one air vent valve 71 are provided. In particular, it should be noted that in the main circuit 220, the temperature of water in the booster heater 54 is the highest. Therefore, the booster heater 54 is the most suitable part to be connected to the pressure relief valve 70. Also, because the booster heater 54 has a certain volume, gas separated from water tends to collect in the booster heater 54. Therefore, the booster heater 54 is also the most suitable part to be connected with the air vent valve 71. The pressure relief valve 70 and the air vent valve 71 are provided in the indoor unit 200.

The pressure relief valve 70 is a protective device which prevents the pressure in the water circuit 210 from excessively rising due to a change in the temperature of water. The pressure relief valve 70 causes water in the water circuit 210 to be discharged from the water circuit 210 to the outside thereof based on the pressure in the water circuit 210. For example, when the pressure in the water circuit 210 rises to exceed a pressure control range of an expansion tank 52 (to be described later), the pressure relief valve 70 is opened to cause water in the water circuit 210 to be discharged therefrom through the pressure relief valve 70.

The air vent valve 71 is a device which causes gas in the water circuit 210 to be discharged from the water circuit 210, thereby preventing idling of the pump 53. The above gas to be discharged is gas which enters the water circuit 210 during installation of the heat-pump hot-water supply heating apparatus 1000 or gas which is separated from the water in the water circuit 210 during a trial run of the heat-pump hot-water supply heating apparatus 1000. As the air vent valve 71, for example, a float-type automatic air-vent valve is used. The float-type automatic air-vent valve has a sealing function of preventing air from flowing backwards, using a float. Therefore, it is not necessary to manually seal the air vent valve 71 at the commencement of operation of the heat-pump hot-water supply heating apparatus 1000 after the installation and trial run of the heat-pump hot-water supply heating apparatus 1000 end.

One of ends of a pipe 72, which serves as a water flow passage branching off from the main circuit 220, is connected to a housing of the booster heater 54. To the other end of the pipe 72, the pressure relief valve 70 is attached. That is, the pressure relief valve 70 is connected to the booster heater 54 by the pipe 72. A branching part 72*a* is provided at an intermediate part of the pipe 72. To the branching part 72*a*, one of ends of a pipe 73 is connected. To the other end of the pipe 73, the air vent valve 71 is attached. That is, the air vent valve 71 is connected to the booster heater 54 by the pipe 73 and pipe 72.

A branching part 72*b* is provided at part of the pipe 72 which is located between the booster heater 54 and the branching part 72*a*. To the branching part 72*b*, one of ends of the pipe 75 is connected. To the other end of the pipe 75, the expansion tank 52 is connected. That is, the expansion tank 52 is connected to the booster heater 54 by the pipe 75 and the pipe 72. The expansion tank 52 is a device which controls a change of the pressure in the water circuit 210, which is made by a change in the temperature of water in the water circuit 210, to fall within a predetermined range.

The branch circuit 221 forming the hot-water supply circuit is provided in the indoor unit 200. An upstream end of the branch circuit 221 is connected to a flow outlet of the three-way valve 55. A downstream end of the branch circuit 221 is connected to the joining part 230. In the branch circuit 221, a coil 61 is provided. The coil 61 is provided in a hot-water storage tank 51 which stores water therein. The coil 61 is means which heats the water stored in the hot-water storage tank 51 by causing heat exchange to be performed between the above water and water (hot water) circulating in the branch circuit 221 of the water circuit 210.

Also, the hot-water storage tank 51 incorporates a submerged heater 60 therein. The submerged heater 60 is a heating unit which further heats the water stored in the hot-water storage tank 51.

A sanitary circuit side pipe 81*a* (for example, a hot-water supply pipe) to be connected to, for example, a shower is connected to an inner upper part of the hot-water storage tank 51. A sanitary circuit side pipe 81*b* (for example, an auxiliary hot-water supply pipe) is connected to inner lower part of the hot-water storage tank 51. A drain hole 63 which allows water to be discharged from the hot-water storage tank 51 is provided at lower part of the hot-water storage tank 51. The hot-water storage tank 51 is covered with a heat-insulating material (not illustrated) to prevent the temperature of water in the tank from dropping as a result of heat transfer to the outside. As the heat insulating material, felt, Thinsulate (registered trademark) or VIP (Vacuum Insulation Panel) is used.

The branch circuit 222 forming part of the heating circuit is provided in the indoor unit 200. The branch circuit 222 includes a supply pipe 222*a* and a return pipe 222*b*. An upstream end of the supply pipe 222*a* is connected to another flow outlet of three-way valve 55. A downstream end of the supply pipe 222*a* is connected to a heating-circuit side pipe 82*a*. An upstream end of the return pipe 222*b* is connected to a heating-circuit side pipe 82*b*. A downstream end of the return pipe 222*b* is connected to the joining part 230. Thereby, the supply pipe 222*a* and the return pipe 222*b* are connected to the heating apparatus 300 by the heating-circuit side pipes 82*a* and 82*b*, respectively. The heating-circuit side pipes 82*a* and 82*b* and the heating apparatus 300 are equipment installed at the designated site, which are located in the indoor space, but outside the indoor unit 200. The branch circuit 222 forms along with the heating-circuit side pipes 82*a* and 82*b* and the heating apparatus 300, the heating circuit.

The heating-circuit side pipe 82*a* is connected to a pressure relief valve 301 and an air vent valve 302. The pressure relief valve 301 is a protective device which prevents the pressure in the water circuit 210 from excessively rising, and has the same structure as or a similar structure to that of, for example, the pressure relief valve 70. The air vent valve 302 is a device which causes gas to be discharged from the water circuit 210 to the outside thereof, and has the same structure as or a similar structure to, for example, the air vent valve 71. The pressure relief valve 301 and the air vent valve 302 are provided in the indoor space, but outside the indoor unit 200.

The pressure relief valve 70 is provided in the main circuit 220. This is because as part of the heat-pump hot-water supply heating apparatus 1000 or the indoor unit 200, the pressure relief valve 70 is intended to protect water pipes in the indoor unit 200 against a pressure. On the other hand, the pressure relief valve 301 is provided outside the indoor unit 200 for the following reason. The heating apparatus 300, the heating-circuit side pipes 82*a* and 82*b* and the pressure relief valve 301 are not part of the heat-pump hot-water supply heating apparatus 1000, and are equipment to be installed by a technician at a designated site in a specific manner which varies from one designated site to another. For example, in existing equipment including a boiler used as a heat source apparatus of the heating apparatus 300, the heat source apparatus may be changed from the boiler to the heat-pump hot-water supply heating apparatus 1000. In such a case, if there is no problem with such equipment, the heating apparatus 300, heating-circuit side pipes 82*a* and 82*b* and pressure relief valve 301 are used as they are.

The air vent valve 71 is provided in the main circuit 220. This is because as part of the heat-pump hot-water supply heating apparatus 1000 or the indoor unit 200, the air vent valve 71 is intended to deal with air which enters the water pipes in the indoor unit 200. On the other hand, the air vent valve 302 is provided outside the indoor unit 200 for the following reason. For example, in the case where the indoor unit 200 is installed on the first floor of a two-story building and the heating apparatus 300 is installed on the second floor, air mixing with water in the heating-circuit side pipe 82*a* provided on the second floor is not discharged from the air vent valve 71 of the indoor unit 200. Thus, in general, the air vent valve 302 is provided at the highest part of the entire water circuit.

The indoor unit 200 is provided with a controller 201 which exerts a control mainly of an operation of the water circuit 210 (for example, the pump 53, the booster heater 54, the three-way valve 55 and the submerged heater 60). The controller 201 includes a microcomputer provided with a CPU, a ROM, a RAM, I/O ports, etc. The controller 201 is formed able to intercommunicate with the controller 101 and the operating portion 202.

The operating portion 202 is configured to allow a user to operate the heat-pump hot-water supply heating apparatus 1000 and make various settings on the system. In embodiment 1, the operating portion 202 is provided with a display unit 203 as a notification unit which indicates information. The display unit 203 can display various information regarding, for example, the state of the heat-pump hot-water supply heating apparatus 1000. The operating portion 202 is provided, for example, on a surface of a housing of the indoor unit 200.

Figure 3:
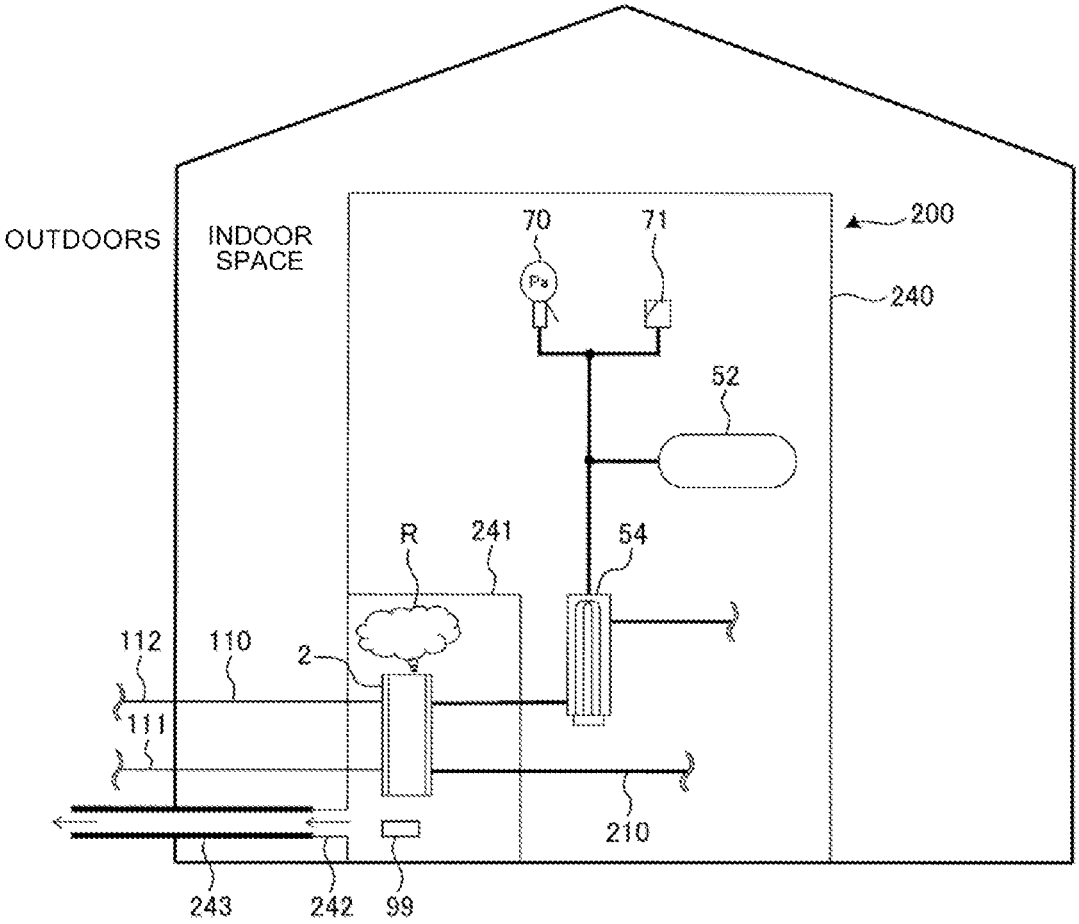
FIG. 3 is a schematic view illustrating a configuration and an installed state of the indoor unit 200 of the heat pump apparatus according to embodiment 1.

FIG. 3 is a schematic view illustrating a configuration and an installed state of the indoor unit 200 of the heat pump apparatus according to embodiment 1. As illustrated in FIG. 3, the indoor unit 200 includes a container 241 which houses the load-side heat exchanger 2. The container 241 is housed in the housing 240 which corresponds to outer peripheral portions of the indoor unit 200. Space in the container 241 is isolated from space located outside the container 241 and in the housing 240. A first opening port 242 is formed in lower part of the container 241 and an opening extending outwards from the housing 240. The first opening port 242 is formed, for example, below the load-side heat exchanger 2. Through the first opening port 242, the space in the container 241 communicates with space located outside the housing 240 without communicating with the space located outside the container 241 and in the housing 240. The container 241 has no opening port (for example, vent hole) which allows air to flow into and out of the container 241, except for the first opening port 242. That is, the container 241 has a substantially sealed structure except for the first opening port 242. On the other hand, the housing 240 may include an opening port which allows air to flow into and out of the housing 240.

In the case where the indoor unit 200 is installed in the indoor space, the first opening port 242 is set to communicate with the outdoor space through a duct 243. Therefore, the first opening port 242 (that is, space in the container 241) communicates with the outdoor space without communicating with the indoor space. Since the first opening port 242 communicates with the outdoors without communicating with the indoor space, the space in the container 241 is isolated from the indoor space. The duct 243 may be packed along with the indoor unit 200 at the time of shipment or may be carried by a technician who can install the heat-pump hot-water supply heating apparatus 1000.

Next, it will be described what operation is performed when the partition wall 410 of the load-side heat exchanger 2 is damaged. The load-side heat exchanger 2 operates as a condenser during the regular operation and as an evaporator during the defrosting operation. Therefore, there is a case where a thermal stress repeatedly acts due to a change in the temperature of refrigerant, and a stress repeatedly acts due to a change in the pressure of the refrigerant, thus causing the partition wall 410 (for example, the first partition wall 411) of the load-side heat exchanger 2 to be damaged.

In embodiment 1, since the load-side heat exchanger 2 has a double-wall structure, even if the first partition wall 411 is damaged, the refrigerant flow passage 401 and the water flow passage 402 will not communicate with each other. It is therefore possible to prevent refrigerant from leaking into the water circuit 210 and thereby prevent the refrigerant from being discharged into the indoor space through any of the pressure relief valves 70 and 301 and the air vent valves 71 and 302.

Even if the first partition wall 411 is damaged, and as a result the refrigerant flows from the refrigerant flow passage 401 into the gap 413, the refrigerant having flowed into the gap 413 is discharged into the space in the container 241 (referring to FIG. 3, refrigerant R is discharged into the space in the container 241). Since the space in the container 241 communicates with the outdoor space through the first opening port 242 and the duct 243, the refrigerant discharged into the above space is then discharged to the outdoor space through the first opening port 242 and the duct 243 by a pressure difference or natural diffusion. Also, since the space in the container 241 is isolated from the indoor space, the refrigerant discharged into the space in the container 241 does not flow into the indoor space.

A refrigerant detection device 99 which detects leakage of refrigerant is provided in the container 241. As the refrigerant detection device 99, for example, a gas sensor which detects the concentration of the refrigerant and outputs a detection signal to the controller 201 is used. The refrigerant detection device 99 is provided below the load-side heat exchanger 2 (for example, just under the load-side heat exchanger 2).

It should be noted that in the case where refrigerant which has a lower density than air under atmospheric pressure is used, it is preferable that the first opening port 242 be provided in upper part of the container 241, and the refrigerant detection device 99 be provided above the load-side heat exchanger 2.

Figure 4:
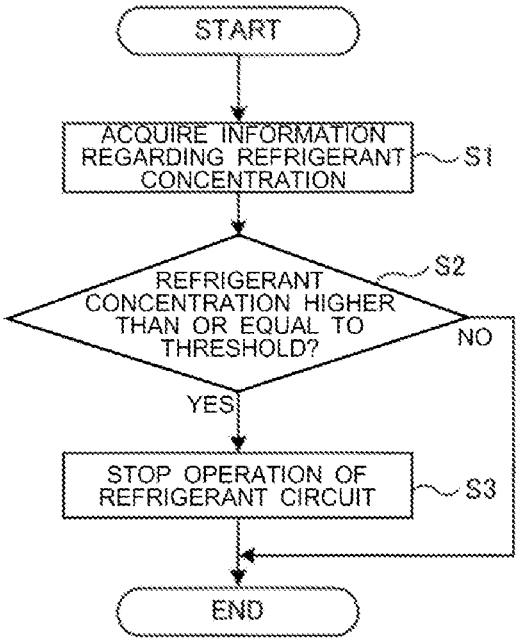
FIG. 4 is a diagram illustrating an example of a refrigerant leakage detection process which is executed by a controller 201 of the heat pump apparatus according to embodiment 1 of the present invention.

FIG. 4 is a flowchart illustrating an example of refrigerant leakage detection process by a controller 201 of the heat pump apparatus according to embodiment 1. The refrigerant leakage detection process is executed at predetermined time intervals at all times including time when the heat-pump hot-water supply heating apparatus 1000 is in operation and time when the heat-pump hot-water supply heating apparatus 1000 is in stopped state, as long as power is supplied.

In step S1 in FIG. 4, based on a detection signal from the refrigerant detection device 99, the controller 201 acquires information regarding the concentration of refrigerant at the vicinity of the refrigerant detection device 99.

Next, in step S2, the controller 201 determines whether the concentration of refrigerant at the vicinity of the refrigerant detection device 99 is higher than or equal to a preset threshold or not. When it is determined that the concentration of refrigerant is higher than or equal to the threshold, the step to be carried out proceeds to step S3. By contrast, when it is determined that the concentration of refrigerant is lower than the threshold, the processing to be executed ends.

In step S3, the controller 201 exerts a control to stop the operation of the refrigerant circuit 110 (for example, the compressor 3), using the controller 101. By contrast, the water circuit 210 (for example, the booster heater 54, the pump 53, the three-way valve 55 and the submerged heater 60) is permitted to operate. Therefore, in the water circuit 210, a heating and hot-water supply operation using hot water in the hot-water storage tank 51 and a heating unit such as the booster heater 54 is continued. In step S3, the display unit 203, a voice output unit or another unit provided on the operating portion 202 may be caused to notify the user of leakage of refrigerant.

As described above, the heat-pump hot-water supply heating apparatus 1000 (an example of the heat pump apparatus) according to embodiment 1 includes the refrigerant circuit 110 which circulates refrigerant, the water circuit 210 (an example of the heat medium circuit) which causes water (an example of the heat medium) to flow, the load-side heat exchanger 2 (an example of the heat exchanger) which causes heat exchange to be performed between the refrigerant and water, and the indoor unit 200 which houses at least the load-side heat exchanger 2. The load-side heat exchanger 2 has a double-wall structure. The indoor unit 200 includes the container 241 which houses the load-side heat exchanger 2. In the container 241, the first opening port 242 is provided to communicate with the outdoor space without communicating with the indoor space.

In this configuration, even if the partition wall 410 of the load-side heat exchanger 2 is damaged and as a result refrigerant flows through the partition wall 410, the refrigerant is discharged into the space in the container 241 and then discharged into the outdoor space through the first opening port 242. Therefore, even if the partition wall 410 of the load-side heat exchanger 2 housed in the indoor unit 200 is damaged, leakage of the refrigerant into the indoor space can be prevented.

Furthermore, in the heat-pump hot-water supply heating apparatus 1000 according to embodiment 1, the refrigerant detection device 99 may be provided in the container 241. In embodiment 1, refrigerant having leaked from the load-side heat exchanger 2 is discharged into the space in the container 241. Therefore, in the above configuration, it is possible to reliably detect that refrigerant leaks from the load-side heat exchanger 2.

In the heat-pump hot-water supply heating apparatus 1000 according to embodiment 1, the operation of the water circuit 210 may be set to be continued even if refrigerant leakage is detected. In this configuration, the heating and hot-water supply operation can be continued even if refrigerant leakage occurs.

In the heat-pump hot-water supply heating apparatus 1000 according to embodiment 1, the operation of the refrigerant circuit 110 may be set to be stopped if refrigerant leakage is detected. In this configuration, it is possible to reduce progression of refrigerant leakage.

In the heat-pump hot-water supply heating apparatus 1000 according to embodiment 1, the refrigerant may be a flammable refrigerant or a toxic refrigerant. In embodiment 1, it is possible to prevent the flammable refrigerant or the toxic refrigerant from leaking into the indoor space.

In a method for installing the heat-pump hot-water supply heating apparatus 1000 according to embodiment 1, when the indoor unit 200 is installed in the indoor space, the first opening port 242 is set to communicate with the outdoor space without communicating with the indoor space.

In this configuration, even if the partition wall 410 of the load-side heat exchanger 2 is damaged, and as a result refrigerant flows through the partition wall 410, the refrigerant is discharged into the space in the container 241 and is then discharged into the outdoor space through the first opening port 242. Therefore, even if the partition wall 410 of the load-side heat exchanger 2 housed in the indoor unit 200 is damaged, leakage of the refrigerant into the indoor space can be prevented.

Embodiment 2

Figure 5:
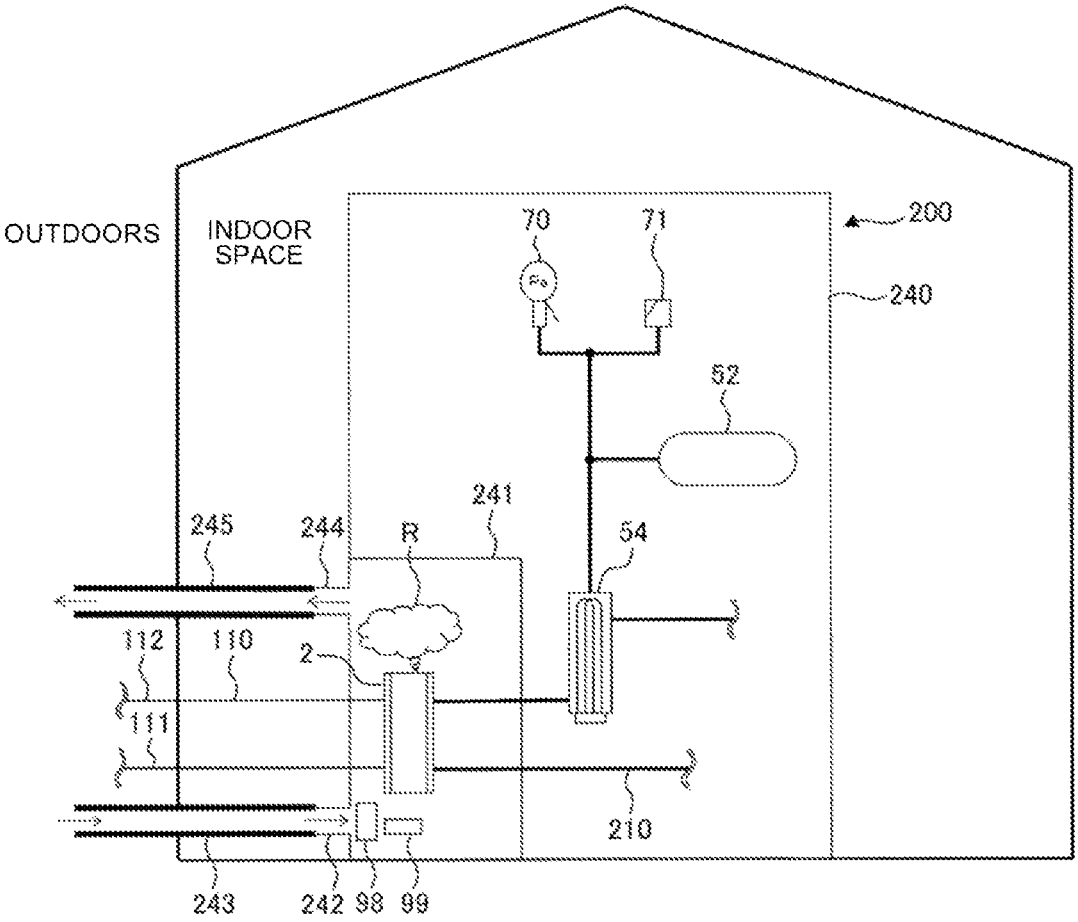
FIG. 5 is a schematic view illustrating a configuration and installed state of an indoor unit 200 of a heat-pump apparatus according to embodiment 2 of the present invention.

A heat pump apparatus according to embodiment 2 of the present invention will be described. FIG. 5 is a schematic view illustrating a configuration and an installed state of an indoor unit 200 of a heat-pump hot-water supply heating apparatus 1000 according to the present embodiment. It should be noted that components which have the same functions and operations as in embodiment 1 will be denoted by the same reference numerals, and their descriptions will be omitted.

As illustrated in FIG. 5, a second opening port 244 is formed in the container 241 in addition to the first opening port 242. The second opening port 244 is formed above the first opening port 242 (for example, above the load-side heat exchanger 2). The second opening port 244, as well as the first opening port 242, is formed to communicate with the outdoor space without communicating with the indoor space.

When the indoor unit 200 is installed in the indoor space, the first opening port 242 is set to communicate with the outdoor space through the duct 243, and the second opening port 244 is set to communicate with the outdoor space through a duct 245. As a result, the space in the container 241 communicates with the outdoor space without communicating with the indoor space, and is isolated from the indoor space.

If refrigerant having leaked from the load-side heat exchanger 2 is discharged into the space inside the container 241, free convection occurs because of a density difference between the refrigerant and air. A gaseous mixture of air and refrigerant (e.g., refrigerant-rich gaseous mixture of air and refrigerant) having a higher density than air flows into the outdoor space from the container 241 through the first opening port 242 and duct 243. Air having a lower density than the gaseous mixture of air and refrigerant flows into the container 241 from the outdoor space through the duct 245 and the second opening port 244. Therefore, in embodiment 2, the refrigerant discharged into the container 241 can be quickly discharged into the outdoor space, since it is possible to utilize only the pressure difference or free diffusion, but free convection. It should be noted that the refrigerant discharged into the outdoor space instantly diffuses, and the refrigerant having flowed into the outdoor space through the duct 243 hardly re-flows into the container 241 through the duct 245.

In the container 241, the refrigerant detection device 99 and a fan 98 are provided. The fan 98 is configured to forcibly produce a current of air which causes air in the outdoor space to flow into the container 241 through the duct 245 and the second opening port 244 and also causes the refrigerant in the container 241 to flow into the outdoor space through the first opening port 242 and the duct 243. For example, if refrigerant leakage is detected by the refrigerant detection device 99, the operation of the fan 98 is started by the control of the controller 201. Thus, in embodiment 2, the refrigerant having flowed into the container 241 can be discharged in the outdoor spaces quickly.

As described above, in the heat-pump hot-water supply heating apparatus 1000 according to embodiment 2, the second opening port 244 is formed in the container 241 at a level different from that of the first opening port 242 to communicate with the outdoor space without communicating with the indoor space.

By virtue of this configuration, the refrigerant having flowed into the container 241 can be quickly discharged into the outdoor space by free convection which occurs due to the density difference between refrigerant and air.

Furthermore, in the heat-pump hot-water supply heating apparatus 1000 according to embodiment 2, the fan 98 is provided in the container 241. If refrigerant leakage is detected, the operation of the fan 98 is started.

In this configuration, the refrigerant having flowed into the container 241 can be quickly discharged into the outdoor space by operating the fan 98.

The present invention is not limited to the embodiments described above, and can be variously modified.

For example, with respect to the above embodiments, although a plate heat exchanger having a double-wall structure is described above as an example of the load-side heat exchanger 2, the load-side heat exchanger 2 may be a heat exchanger other than the plate heat exchanger, for example, a double-pipe heat exchanger having a double-wall structure.

Furthermore, with respect to the above embodiments, although the heat-pump hot-water supply heating apparatus 1000 is described above as an example of a heat pump apparatus, the present invention is also applicable to a chiller or similar heat pump apparatuses.

Also, with respect to the above embodiments, although the indoor unit 200 provided with the hot-water storage tank 51 is described by way of example, the hot-water storage tank may be provided separately from the indoor unit 200.

The above embodiments and modifications can be put to practical use in combination.

REFERENCE SIGNS LIST

1 heat-source-side heat exchanger 2 load-side heat exchanger

3 compressor 4 refrigerant flow switching device 5 intermediate-pressure receiver 6 first pressure-reducing device 7 second pressure-reducing device 11 suction pipe 51 hot-water storage tank 52 expansion tank 53 pump 54 booster heater 55 three-way valve 56 strainer 57 flow switch 60 submerged heater 61 coil 62, 63 drain hole 70 pressure relief valve 71 air vent valve 72, 73, 75 pipe 72*a*, 72*b* branching part 81*a*, 81*b* sanitary circuit side pipe 82*a*, 82*b* heating-circuit side pipe 98 fan

99 refrigerant detection device 100 outdoor unit 101 controller

102 control line 110 refrigerant circuit 111, 112 connection pipe 200 indoor unit 201 controller 202 operating portion

203 display unit 210 water circuit 220 main circuit 221, 222 branch circuit 222*a* supply pipe 222*b* return pipe 230 joining part 240 housing 241 container 242 first opening port 243 duct 244 second opening port 245 duct 300 heating apparatus 301 pressure relief valve 302 air vent valve 401 refrigerant flow passage 402 water flow passage 410 partition wall 411 first partition wall 412 second partition wall 413 gap 1000 heat-pump hot-water supply heating apparatus R refrigerant

The invention claimed is:

1. A heat pump apparatus comprising:

a refrigerant circuit configured to circulate refrigerant;

a heat medium circuit configured to make a heat medium flow;

a heat exchanger configured to cause exchange heat to be performed between the refrigerant and the heat medium;

an indoor unit housing at least the heat exchanger, the indoor unit being provided in an indoor space; and a first duct and a second duct, the heat exchanger having a double-wall structure, the indoor unit including a container housing the heat exchanger, and the container including a first opening port formed in the container to communicate with an outdoor space without communicating with the indoor space, wherein the first opening port allows air flow between the outdoor space and a space in the container outside of the heat exchanger, in the container, a second opening port is formed at a level different from that of the first opening port to communicate with the outdoor space without the indoor space, and the second opening port allows air flow between the outdoor space and the space in the container outside of the heat exchanger, the indoor unit has a housing which corresponds to outer peripheral portions of the indoor unit, the container being housed in the housing, the first opening port extends outwards from the housing and allows the air flow between the outdoor space and the space in the container outside of the heat exchanger through the first duct, and the second opening port extends outwards from the housing and allows the air flow between the outdoor space and the space in the container outside of the heat exchanger through the second duct.

2. The heat pump apparatus of claim 1, wherein in the container, a refrigerant detection device is provided.

3. The heat pump apparatus of claim 2, wherein an operation of the heat medium circuit is not stopped even when leakage of the refrigerant is detected.

4. The heat pump apparatus of claim 2, wherein an operation of the refrigerant circuit is stopped when leakage of the refrigerant is detected.

5. The heat pump apparatus of claim 2, wherein in the container, a fan is provided, and an operation of the fan is started when leakage of the refrigerant is detected.

6. The heat pump apparatus of claim 1, wherein the refrigerant is a flammable refrigerant or a toxic refrigerant.

7. The heat pump apparatus of claim 1, wherein the first opening port is separate from the refrigerant circuit.

8. The heat pump apparatus of claim 2, wherein the second opening port is separate from the refrigerant circuit.

9. The heat pump apparatus of claim 1, wherein the container has a substantially sealed structure except for the first opening port.

10. The heat pump apparatus of claim 2, wherein the container has a substantially sealed structure except for the first opening port and the second opening port.

11. A method for installing a heat pump apparatus comprising:

a refrigerant circuit configured to circulate refrigerant, a heat medium circuit configured to make a heat medium flow, a heat exchanger configured to cause heat exchange to be performed between the refrigerant and the heat medium, an indoor unit housing at least the heat exchanger, and a first duct and a second duct, the heat exchanger having a double-wall structure, the indoor unit including a container housing the heat exchanger, the container including first and second opening ports formed therein, the indoor unit has a housing which corresponds to outer peripheral portions of the indoor unit, the container being housed in the housing, the method comprising setting, when installing the indoor unit in an indoor space, the first opening port such that the first opening port communicates with an outdoor space without communicating with the indoor space, and such that the first opening port allows air flow between the outdoor space and a space in the container outside of the heat exchanger through the first duct, and setting, when installing the indoor unit in the indoor space, the second opening port such that the second opening port communicates with the outdoor space without communicating with the indoor space, such that the second opening port allows air flow between the outdoor space and the space in the container outside of the heat exchanger through the second duct, and such that the second opening port is at a level different from that of the first opening port.

12. A heat pump apparatus comprising:

a refrigerant circuit configured to circulate refrigerant;

a heat medium circuit configured to make a heat medium flow;

a heat exchanger configured to cause exchange heat to be performed between the refrigerant and the heat medium; and an indoor unit housing at least the heat exchanger, the indoor unit being provided in an indoor space; and a first duct and a second duct, the heat exchanger having a double-wall structure, the indoor unit including a container housing the heat exchanger, the container including one or more opening ports formed in the container to communicate with an outdoor space without communicating with the indoor space, wherein the container has a substantially sealed structure except for the one or more opening ports, in the container, a second opening port from the one or more opening ports is formed at a level different from that of a first opening port of the one or more opening ports to communicate with the outdoor space without the indoor space, and the second opening port allows air flow between the outdoor space and the space in the container outside of the heat exchanger, the indoor unit has a housing which corresponds to outer peripheral portions of the indoor unit, the container being housed in the housing, the first opening port extends outwards from the housing and allows the air flow between the outdoor space and the space in the container outside of the heat exchanger through the first duct, and the second opening port extends outwards from the housing and allows the air flow between the outdoor space and the space in the container outside of the heat exchanger through the second duct.

* * * * *